US009331458B2

(12) United States Patent
Okabe et al.

(10) Patent No.: US 9,331,458 B2
(45) Date of Patent: May 3, 2016

(54) IGNITION SYSTEM

(71) Applicant: DENSO CORPORATION, Kariya, Aichi (JP)

(72) Inventors: Shinichi Okabe, Aichi-ken (JP); Yoshihiro Nakase, Okazaki (JP); Akimitsu Sugiura, Nagoya (JP); Yuya Abe, Nagoya (JP)

(73) Assignee: DENSO CORPORATION, Kariya (JP)

( * ) Notice: Subject to any disclaimer, the term of this patent is extended or adjusted under 35 U.S.C. 154(b) by 357 days.

(21) Appl. No.: 14/134,217

(22) Filed: Dec. 19, 2013

(65) Prior Publication Data

US 2014/0174416 A1 Jun. 26, 2014

(30) Foreign Application Priority Data

Dec. 20, 2012 (JP) ..... 2012-277679

(51) Int. Cl.

| | |
|---|---|
| ***H01T 13/20*** | (2006.01) |
| ***H01T 13/52*** | (2006.01) |
| *H01T 13/50* | (2006.01) |
| *F02P 9/00* | (2006.01) |

(52) U.S. Cl.

CPC ..... *H01T 13/52* (2013.01); *F02P 9/007* (2013.01); *H01T 13/20* (2013.01); *H01T 13/50* (2013.01)

(58) Field of Classification Search

CPC ..... H01T 13/20; H01T 21/02; H01T 13/38
USPC ..... 313/130, 137, 141, 143, 144
See application file for complete search history.

(56) References Cited

U.S. PATENT DOCUMENTS

| | | | | |
|---|---|---|---|---|
| 4,439,707 | A * | 3/1984 | Hattori | H01T 13/39 313/130 |
| 5,469,013 | A | 11/1995 | Kang | |
| 6,078,130 | A * | 6/2000 | Lepley | H01T 13/52 313/130 |

FOREIGN PATENT DOCUMENTS

| | | |
|---|---|---|
| JP | 2010-37949 | 2/2010 |
| JP | 2012-184718 | 9/2012 |

OTHER PUBLICATIONS

Office Action (3 pgs.) dated Oct. 5, 2015 issued in corresponding Japanese Application No. 2012-277679 with an at least partial English language translation (2 pgs.).

* cited by examiner

*Primary Examiner* — Vip Patel
(74) *Attorney, Agent, or Firm* — Nixon & Vanderhye PC

(57) ABSTRACT

An ignition system for an internal combustion engine includes a discharge portion of the center electrode in which a part thereof is surrounded by a bottom portion and a tubular tip portion of the center dielectric, the part of the discharge portion and the tubular tip portion are projected into a combustion chamber of the internal combustion engine from a substantially annular tip portion of the ground electrode that opens to the combustion chamber at a distal end of the ground electrode, a diameter-changing portion formed by reducing a diameter of a part of the tubular tip portion in a radial direction gradually as approaching toward a tip thereof, and a thin-walled portion formed by reducing a thickness of the tip of the tubular tip portion.

8 Claims, 12 Drawing Sheets

FIG.3B
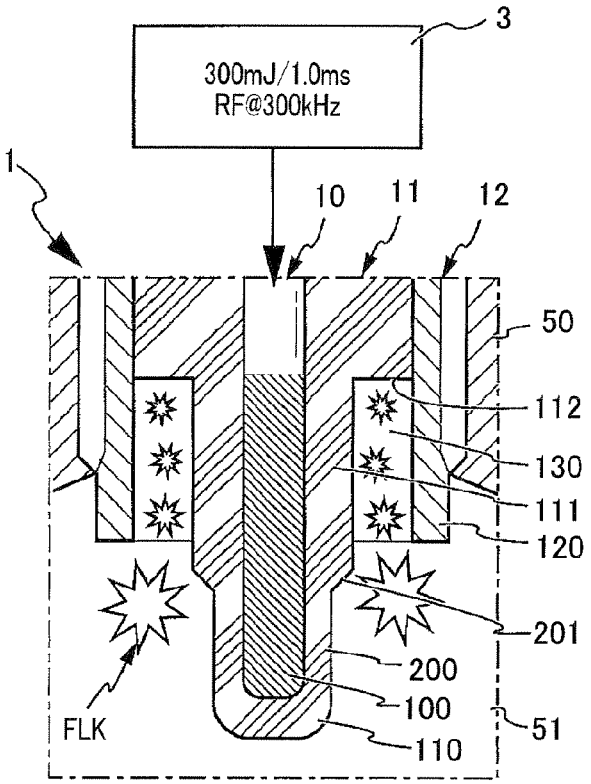
FIG.4A (1ST COMPARATIVE EXAMPLE)
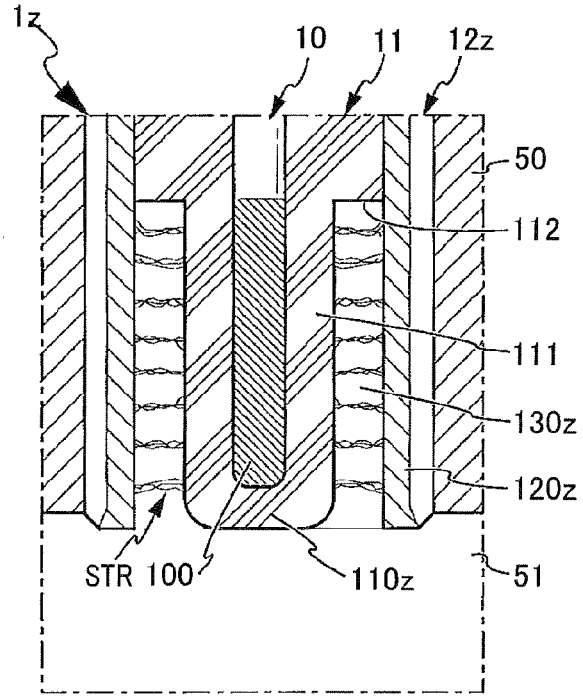

FIG.4B (1ST COMPARATIVE EXAMPLE)
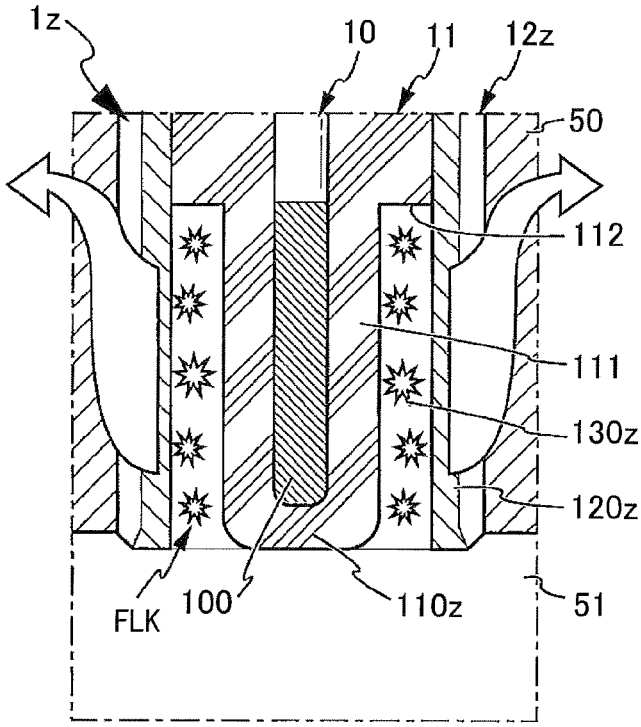
FIG.5A (2ND COMPARATIVE EXAMPLE)
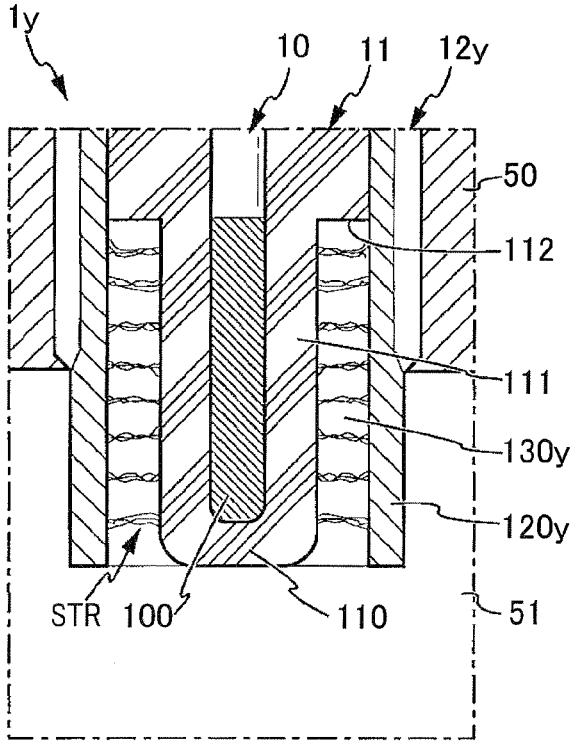

(2ND COMPARATIVE EXAMPLE)

3RD EMBODIMENT

4TH EMBODIMENT

5TH EMBODIMENT

5TH EMBODIMENT

IGNITION SYSTEM

CROSS-REFERENCE TO RELATED APPLICATION

This application is based on and claims the benefit of priority from earlier Japanese Patent Application No. 2012-277679 filed Dec. 20, 2012, the description of which is incorporated herein by reference.

TECHNICAL FIELD

The present disclosure relates to an ignition system for igniting fuel-air mixture having soft ignition characteristics in an internal combustion engine.

BACKGROUND

In recent years, in order to improve fuel efficiency and reduce $CO_2$, development of a high-efficiency engine to achieve small size, low $NO_X$ and high output is in progress.

Since the high-efficiency engine is under conditions of high-boost, high-compression, and lean fuel concentration of the fuel-air mixture, thus it is in an environment that igniting with a spark is difficult.

In order to start combustion in such an internal combustion engine which is difficult to ignite with high efficiency, an ignition system with a quick burning rate and an excellent ignitability is desired.

An internal combustion engine that injects fuel directly into a cylinder having a first electrode, a second electrode that surrounds the first electrode, an ignition chamber that communicates with a combustion chamber through an opening formed between the first and second electrodes, an active species generating unit that generates active species in the ignition chamber by applying a voltage between the first and second electrodes, and a control unit that varies an operating time of the active species generating unit is disclosed in Japanese Patent Application Laid-Open Publication No, 2010-37949.

In the internal combustion engine mentioned above, a fuel injector and the active species generating unit are disposed so that the active species are drawn into the cylinder from the ignition chamber.

However, the active species generating unit as in the Publication '949, the opening is disposed so as to be flush with an inner wall of a cylinder head of the engine in a state where a position of a tip of a center electrode matches an opening end of the ignition chamber, and has a structure to draw the active species generated in the ignition chamber (discharge space) into the combustion chamber using an air flow flowing in the combustion chamber.

Therefore, since a volume ignition which has occurred in the ignition chamber is drawn into the combustion chamber before it grows to a flame capable of igniting air-fuel mixture in the combustion chamber by flame propagation, it becomes difficult to ignite a lean air-fuel mixture.

Further, since it has a structure in which the ignition chamber is retracted inside the cylinder head, diffusion of the energy into the cylinder head is large, and energy applied is not used for ignition in an efficient manner. Thereby, it is found that the air-fuel ratio cannot be increased above a certain level in the internal combustion engine with limited power supply such as in a real vehicle.

SUMMARY

An embodiment provides an ignition system that can improve ignitability using energy efficiently by generating a streamer discharge intensively in a boundary portion between a center electrode and a combustion chamber.

In an ignition system according to a first aspect, the ignition system includes a substantially shaft-like center electrode that has a length with a base end and a tip end in both ends thereof, a substantially bottomed cylindrical center dielectric disposed coaxially with the center electrode, a substantially cylindrical ground electrode disposed coaxially with the center dielectric with a discharge gap having a predetermined distance therebetween, and a power source that applies a high voltage between the center electrode and the ground electrode.

The ignition system further includes a discharge portion of the center electrode in which a part thereof is surrounded by a bottom portion of the center dielectric, and a tubular tip portion of the center dielectric.

The part of the discharge portion and the tubular tip portion are projected into a combustion chamber of the internal combustion engine from a substantially annular tip portion of the ground electrode that opens to the combustion chamber at a distal end of the ground electrode.

The ignition system further includes a diameter-changing portion formed by reducing a diameter of a part of the tubular tip portion in a radial direction gradually as approaching toward a tip thereof, and a thin-walled portion formed by reducing a thickness of the tip of the tubular tip portion.

According to the present disclosure, since a tip of the discharge portion is disposed in the combustion chamber inner than the tip portion of the ground electrode, and the thin-walled portion is formed on tubular tip portion of the center dielectric, a surface potential becomes high locally and a streamer discharge can be easily generated between the thin-walled portion and the tip portion of the ground electrode that are projecting inside the combustion chamber at a distal end side of the tip portion, so that a stable ignition becomes possible with a higher A/F lean limit even if a power supply having a relatively low frequency is used.

In the ignition system according to a second aspect, a substantially cylindrical discharge space is formed by a part of an outer peripheral surface of the tubular tip portion, a bottom end formed by enlarging a base end side of the tubular tip portion in a radial direction, and an inner circumferential surface of a tubular portion of the ground electrode.

When measured from an inner bottom surface of the bottom end, a length to a distal end of the discharge portion is defined as a discharge portion length $L_{100}$, a length to a distal end of the discharge space is defined as a discharge space length $L_{130}$, and a length to the diameter-changing portion is defined as a thin-walled end position length $L_{200}$, a relationship of $L_{130}<L_{200}<L_{100}$ is satisfied.

In the ignition system according to a third aspect, a relationship of 3 mm$<=L_{200}<=$10 mm is satisfied.

In the ignition system according to a fourth aspect, when an outer diameter of the tubular tip portion is defined as $\phi D_{111}$, a thickness thereof is defined as $T_{111}$, an outer diameter of the thin-walled portion is defined as $\phi D_{200}$, and a thickness thereof is defined as $T_{200}$, relationships of $D_{200}<D_{111}$ and $0.2T_{111}<T_{200}<0.9T_{111}$ are satisfied.

In the ignition system according to a fifth aspect, a relationship of 0.4 mm$<=T_{200}<=$1.8 mm is satisfied.

In the ignition system according to a sixth aspect, a frequency of the voltage supplied from the power supply is more than 80 kHz, and less than 850 kHz.

In the ignition system according to a seventh aspect, a volume of the discharge space is 300 $mm^3$ or less.

BRIEF DESCRIPTION OF THE DRAWINGS

In the accompanying drawings:

FIG. 3B schematically shows the cross-sectional view of the principal part in a state of a volume ignition occurring subsequent to FIG. 3A, which is an effect of the ignition system in the first embodiment;

FIG. 4A schematically shows a cross-sectional view of a principal part of a conventional ignition system when a high voltage is applied in a first comparative example;

FIG. 4B schematically shows the cross-sectional view of the principal part in a state of a volume ignition occurring subsequent to FIG. 4A, which is an effect of the ignition system in the first comparative example;

FIG. 5A schematically shows a cross-sectional view of a principal part of a conventional ignition system when a high voltage is applied in a second comparative example;

DETAILED DESCRIPTION OF THE PREFERRED EMBODIMENTS

Figure 1:
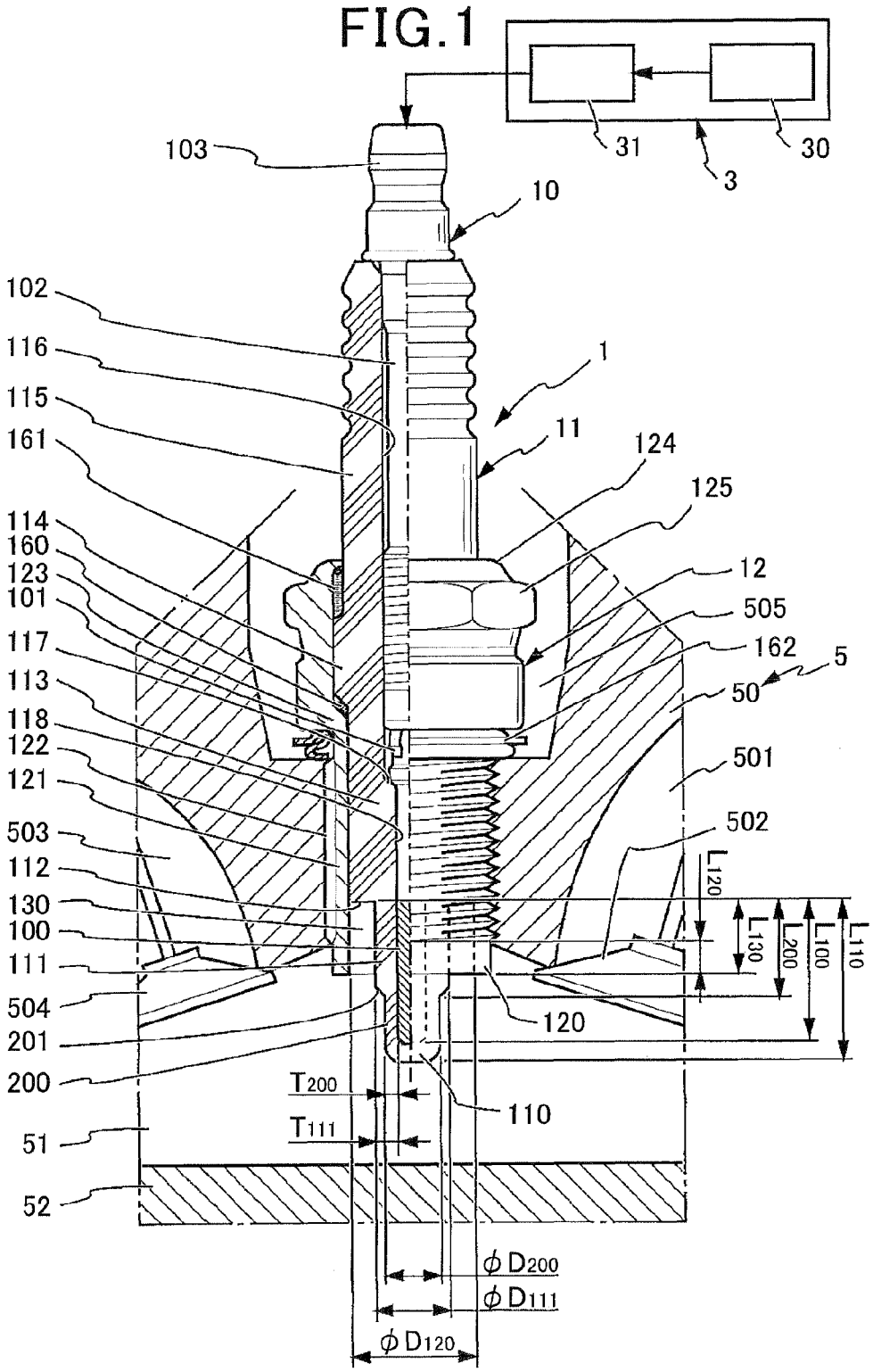
FIG. 1 shows a partial sectional view of an overall outline of an ignition system in a first embodiment of the present disclosure.

With reference to FIG. 1, hereinafter will be described an outline of the ignition system 1 according to a first embodiment of the present disclosure.

An ignition system 1 for igniting fuel-air mixture in an internal combustion engine 5 includes a substantially shaft-like center electrode 10. The center electrode 10 has a length, and has a base end and a tip end in both ends.

The ignition system 1 further includes a substantially bottomed cylindrical center dielectric 11 that surrounds the center electrode 10, a substantially cylindrical ground electrode 12 (housing) disposed coaxially with the center dielectric 11 with a discharge gap having a predetermined distance therebetween, and a high-energy power source 3 that applies an AC high voltage (e.g., ±20 kV~50 kV) having a predetermined frequency (more than 80 kHz, and less than 850 kHz) between the center electrode 10 and the ground electrode 12.

The base end of the center electrode 10 is connected to the power source 3, while the tip end is inserted into a combustion chamber 51 of the internal combustion engine 5.

A substantially cylindrical discharge space 130 is formed by a part of an outer peripheral surface of a tubular tip portion 111 of the center dielectric 11, a bottom end 112 formed by enlarging the base end side of the tubular tip portion 111 in a radial direction, and an inner circumferential surface of a tubular portion 121 of the ground electrode 12.

Further, a part of a discharge portion 100 of the center electrode 10 is surrounded by a tip bottom 110 forming a bottom of the dielectric 11 and the tubular tip portion 111. The part of the discharge portion 100 is projected into the combustion chamber 51 of the internal combustion engine 5 from a substantially annular tip portion 120 of the ground electrode 12 that opens to the combustion chamber 51 at a distal end of the ground electrode 12.

In addition, the tubular tip portion 111 is projected into the combustion chamber 51 from the tip portion 120 of the ground electrode 12, a diameter-changing portion 201 is formed by reducing a diameter of a part of the tubular tip portion 111 in a radial direction gradually as approaching toward a tip thereof, and a thin-walled portion 200 is formed by reducing a thickness $T_{200}$ of the tip of the tubular tip portion 111.

The center electrode 10 is made of highly conductive material and is formed in a long shaft-like shape. The center electrode 10 is composed of a discharge portion 100, a coupling portion 101, a stem portion 102, and a terminal portion 103.

A nickel alloy having a high conductivity and an excellent heat resistance, or an alloy combining a highly conductive material such as copper with the nickel alloy may be used for the center electrode 10.

Incidentally, the discharge portion 100 and the stem portion 102 are provided separately in order to facilitate the molding, and are electrically connected through the coupling portion 101.

Further, a hatched portion of the discharge portion 100 in FIG. 1 is a range capable of causing a discharge between the tip portion 120 and the tubular portion 121 of the ground electrode 12 through the tubular tip portion 111 and the tip bottom 110 of the center dielectric 11.

However, although this hatched portion is called the discharge portion 100, a portion in the base end side without a hatching is not formed separately from the hatched portion, but formed unitarily with the hatched portion up to the coupling portion 101.

The terminal portion 103 is connected to the high-energy power source 3 that is provided outside.

The high-energy power supply 3 is constituted by an AC high voltage power supply 31 and an electronic control unit 30 that controls operating conditions of the internal combustion engine 5, and applies an AC voltage of predetermined frequency (e.g., more than 80 kHz, and less than 850 kHz, with a generated voltage of ±20 kV~50 kV) to the center electrode 10 at a predetermined timing in accordance with the operating conditions of the internal combustion engine 5.

The center dielectric 11 is formed into a substantially bottomed cylindrical shape with a dielectric material having a high heat-resistant such as alumina, and zirconia.

The center dielectric 11 is constituted by the tip bottom 110, the tubular tip portion 111, the bottom end 112, an electrode holding portion 113, an enlarged diameter portion 114, a head portion 115, center electrode insertion holes 116, 118, and an engaging surface 117.

The diameter-changing portion 201 and the thin-walled portion 200, which are principal elements of the present disclosure, are formed on a part of the tubular tip portion 111.

The enlarged diameter portion 114 is enlarged outwardly in the radial direction, and is fixed to the housing 12 (ground electrode) through substantially annular sealing members 160, 161 intervened therebetween by crimping the housing 12 from a vertical direction.

The sealing members 160, 161 ensure airtightness by using known sealing members such as a substantially annular metal seal, a powder compact formed of substantially cylindrical talc, and the like.

The head portion 115 exposed to the base end side of the housing 12 secures insulation so that the discharge does not occur between the terminal portion 103 and the housing 12.

The base end side of the head portion 115 may be formed with a corrugated shape having uneven surfaces disposed alternately in order to increase an insulation length, if necessary, so that a creeping discharge between the electrode terminal portion 103 and the housing 12 occurs less frequently.

The long shaft-like center electrode 10 is inserted into the center electrode insertion holes 116, 118, and is fixed by a coupling portion 101 of the center electrode 10 engages the engaging surface 117.

The housing 12 is formed in a substantially cylindrical shape by using a known metal material as iron, nickel, stainless steel or the like.

The housing 12 is constituted by the substantially annular tip portion 120 that exposes by a predetermined height $L_{120}$ from an inner wall of a cylinder head 50 into the combustion chamber 51, the tubular portion 121 that marks out the discharge space 130 between the center dielectric 11, a threaded portion 122 for fixing to the cylinder head 50, an engagement portion 123 for holding the enlarged diameter portion 114 of the central dielectric 11, a crimping portion 124 that crimps and fixes the enlarged diameter portion 114 through the sealing members 160, 161, a hexagonal portion 125 for screw-tightening the threaded portion 122, and the like.

The housing 12 is in a ground state with the cylinder head 50, and serves as a ground electrode.

Incidentally, since the ignition system 1 of the present disclosure does not generate thermal plasma during discharging, the electrode is hardly worn, thus it is not necessary to use a special material having excellent heat resistance such as iridium for the tip portion 120, the discharge portion 100 or the like, and materials used in the spark plug in general can be appropriately selected.

In the present disclosure, when measured from an inner bottom surface of the bottom end 112 that marks out the discharge space 130 of the center dielectric 11, a length to a distal end of the discharge portion 100 is defined as a discharge portion length $L_{100}$, a length to a distal end of the discharge space 130 is defined as a discharge space length $L_{130}$, and a length to the diameter-changing portion 201 is defined as a thin-walled end position length $L_{200}$, a relationship of $L_{130}<L_{200}<L_{100}$ is satisfied.

Note that from intensive examinations of the inventors of the present disclosure, it is found that the thin-walled end position length $L_{200}$ is configured satisfying a relationship of $3\ mm<=L_{200}<=10\ mm$ is desirable.

Incidentally, critical significance values of the thin-walled end position length $L_{200}$, the wall thickness $T_{200}$ (described later), a volume of the discharge space 130, the frequency of the high-frequency power source 3, etc., in a test described below are configured determining there is no effect if only the same level of an A/F lean limit as in a Second comparative example is obtained.

In addition, a condition that exceeds an A/F lean limit of fourth and fifth comparative examples, and exceeds a constant and stable A/F lean limit (e.g., 21) is determined as a more desirable value.

Furthermore, when an outer diameter of the tubular tip portion 111 is defined as $\phi D_{111}$, a thickness thereof is defined as $T_{111}$, an outer diameter of the thin-walled portion 200 is defined as $\phi D_{200}$, and a thickness thereof is defined as $T_{200}$, relationships of $D_{200}<D_{111}$ and $0.2T_{111}<T_{200}<0.9T_{111}$ are satisfied.

More preferably, it is found that it is configured satisfying a relationship of $0.4\ mm<=T_{200}<=1.8\ mm$ is desirable.

Furthermore, it is found that the volume of the discharge space 130 is 300 $mm^3$ or less is desirable.

The internal combustion engine 5 to which the present disclosure is applied is briefly explained. The internal combustion engine 5 as an example in the present embodiment is a so-called four-cycle engine.

The internal combustion engine 5 is constituted by the combustion chamber 51 defined by a cylinder (not shown), a cylinder head 50 that covers an upper surface of the cylinder, and a top face of a piston 52 held vertically movable inside the cylinder, an intake port 501 disposed in the cylinder head 50, an intake valve 502 for opening and closing the intake port 501, an exhaust port 503 disposed in the cylinder head 50, an exhaust valve 504 for opening and closing the exhaust port 503, and the like.

An ECU 30 commands a fuel injector (not shown) to inject fuel into the combustion chamber 51 and applies a predetermined AC voltage from the high-frequency power source 31 to the ignition system 1 at a predetermined timing according to operating conditions of the internal combustion engine 5. Then non-equilibrium plasma is generated at a boundary of the discharge space 130 and the combustion chamber 51, and ignites air-fuel mixture in the combustion chamber 51.

The present disclosure is not limited particularly to the internal combustion engine 5, but is applicable to various fuel systems such as a gasoline fuel system, a diesel fuel system or a gas fuel system.

Figure 2:
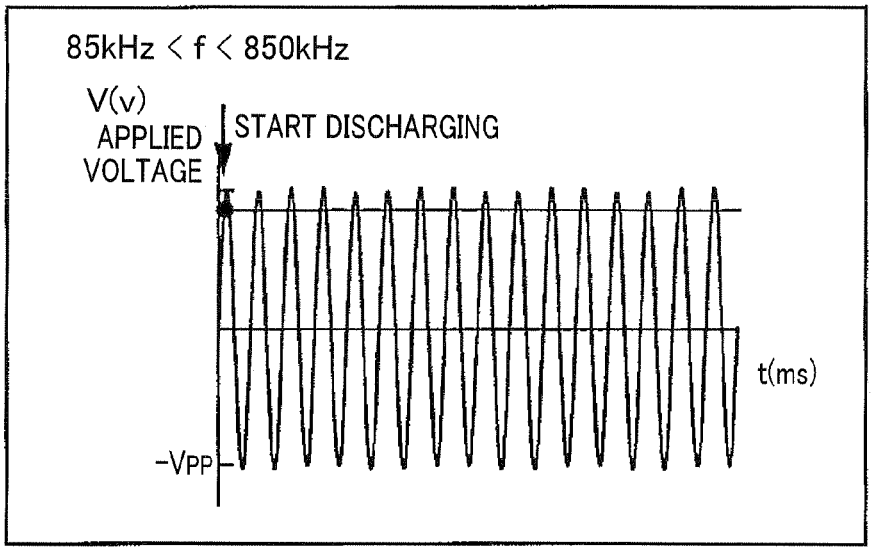
FIG. 2 shows a characteristic diagram showing an example of a high frequency power supply used in the present disclosure.

An example of the high-frequency power source 3 used in the present disclosure is explained with reference to FIG. 2.

The AC high voltage supplied from the high-energy power source 3 used in the present disclosure has a high frequency f (for example, frequency of 80 kHz~850 kHz), and a fixed amount (for example, 1 mJ) of energy per one cycle is supplied from the high voltage power supply 31 with the maximum voltage $V_{PP}$ (e.g., ±20 kV~50 kV) alternating current.

A streamer discharge is discharged intermittently in synchronization with the frequency f of the AC high voltage power supply 31. Naturally, the number of discharges per unit time increases as the power supply frequency becomes high, and the ignition energy also increases.

An effect of the ignition system 1 in the first embodiment of the present disclosure is explained with reference to FIGS. 3A and 3B.

Figure 3A:
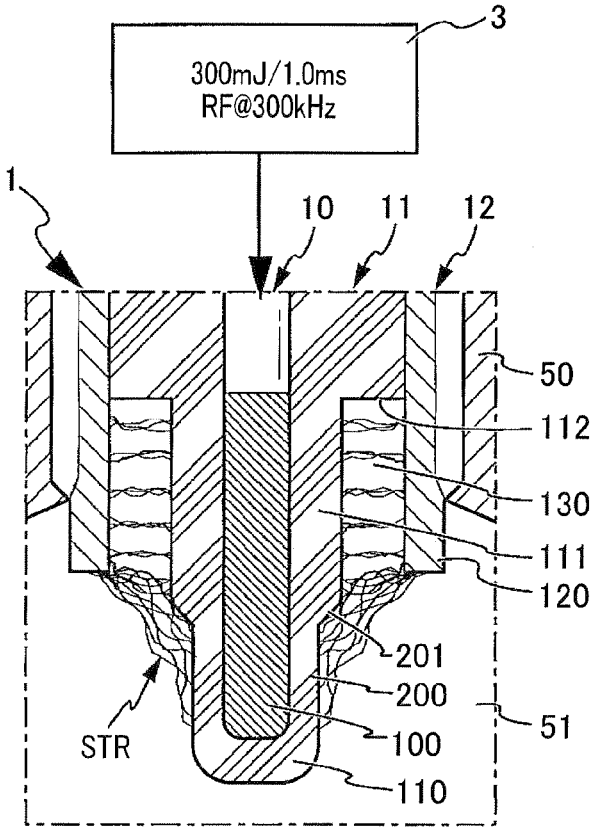
FIG. 3A schematically shows a cross-sectional view of a principal part of the ignition system when a high voltage is applied in the first embodiment.

As shown in FIGS. 3A and 3B, when energy of 300 mJ is applied for 1.0 ms at relatively low frequency of 300 kHz, for example, from the high-energy power source 3, streamer discharge STR occurs simultaneously and multiply between the tip portion 120 and the tubular portion 121 of the ground electrode 12, and the tubular tip portion 111, the diameter-changing portion 201 and the thin-walled portion 200 of the center dielectric 11.

At this time, since the thin-walled portion 200 is disposed on a position of the combustion chamber 51 side rather than the tip portion 120, a surface potential of the thin-walled portion 200 is higher than a case where the thin-walled portion 200 is not formed, an electric field concentration occurs near the portion where the tip portion 120 is open toward the combustion chamber 51, and the energy density between the tip portion 120 and the thin-walled portion 200 increases.

Then, an initial flame kernel FLK occurs in a position where a flame propagation to the combustion chamber is easy to occur in the discharge space 130 and in a distal end of the tip portion 120 where the energy density becomes high, and the initial flame kernel FLK rapidly spreads in the fuel-air mixture in the combustion chamber 51 and realizes a stable ignition.

At this time, since the discharge space 130 is formed with a relatively small volume of 300 $mm^3$ or less, flame occurring in the discharge space 130 is confined therein, and there is no flame unnecessarily released to the cylinder head 50.

Further, since the tip portion 120 of the ground electrode 12 is projected into the combustion chamber 51, this projection limits an air flow in the cylinder moderately, thus a flame kernel which has occurred in the discharge space 130 will never be blown out, and a growth of the flame is expedited further by introducing fresh air into the discharge space 130.

Moreover, since the diameter-changing portion 201 is disposed on a position of firing side rather than the tip portion 120, it is difficult for the flame kernel FLK to become a barrier when the flame kernel FLK occurring in the discharge space 130 is expanded, therefore, flame growth becomes faster, and it is assumed that ignition stability is improved.

Problems of a conventional ignition system 1*z* shown as a first comparative example are explained with reference to FIGS. 4A and 4B.

It should be appreciated that, in the first comparative example and the subsequent comparative example, and in the other embodiments, components identical with or similar to those in the first embodiment are given the same reference numerals, and structures and features thereof will not be described in order to avoid redundant explanation. In addition, components not identical with or similar to those in the first embodiment are given an alphabet, z in the first comparative example, as a branch number next to the reference numeral.

As shown in FIG. 4A, a tip portion 120*z* extending in a substantially cylindrical shape so as to surround a range up to a distal end of the tip bottom portion 110 is formed as a ground electrode 12*z* in the ignition system 1*z*.

Further, a distal end of the ground electrode 120*z* is disposed substantially flush with an inner circumferential surface of the cylinder head 50 so as not to be exposed from the cylinder head 50, and a volume of a discharge space 130*z* is approximately twice the volume in the first embodiment.

When the high voltage is applied to the ignition system 1*z* under the same conditions as in the first embodiment, the streamer discharge STR occurs multiply in the discharge space 130*z*. However, as shown in FIG. 4B, since the volume of the discharge space 130*z* is large, the propagation speed of the flame into the combustion chamber 51 becomes slow even if the flame kernel occurs in the discharge space 130*z*.

Therefore, the energy released to the cylinder head 50 through the tubular portion 121 is increased, thus causes a misfire, or causes a pre-ignition by a tubular tip portion 111*z* of the central dielectric 11*z* being heated excessively, and it becomes difficult to maintain the stable ignition.

Figure 5B:
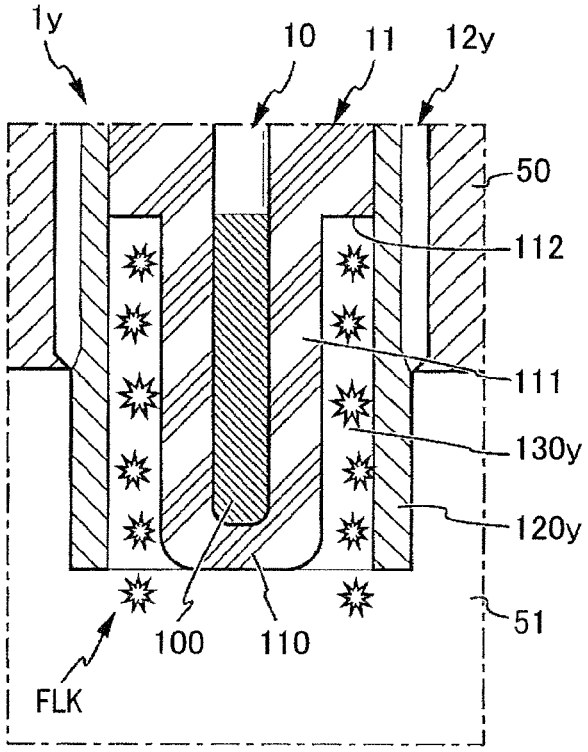
FIG. 5B schematically shows the cross-sectional view of the principal part in a state of a volume ignition occurring subsequent to FIG. 5A, which is an effect of the ignition system in the second comparative example.

Problems of a conventional ignition system 1*y* shown as a second comparative example are explained with reference to FIGS. 5A and 5B.

A tip portion 120*y* extending in a substantially cylindrical shape so as to surround a range up to a distal end of the tip bottom portion 110 is formed as a ground electrode 12*y* in the ignition system 1*y*, however, a part of the tip portion 120*y* is configured so as to be exposed from the cylinder head 50.

When the high voltage is applied to the ignition system 1*y* under the same conditions as the above, the streamer discharge STR occurs multiply in the discharge space 130*y* similar to the first comparative example.

Since the part of the tip portion 120*y* is exposed from the cylinder head 50 in the ignition system 1*y*, the air flow in the combustion chamber 51 is limited by the exposed part, and the flame kernel generated in the discharge space 130*y* and the air-fuel mixture within the combustion chamber 51 are stirred and mixed moderately, thus the ignition of the internal combustion engine 5 can be realized, thereby it becomes possible to suppress the pre-ignition problem of the first comparative example.

However, as shown in a test results described later, a possibility is found in the second comparative example that the stable ignition cannot be realized when the air-fuel ratio of the mixture is increased.

Figure 6:
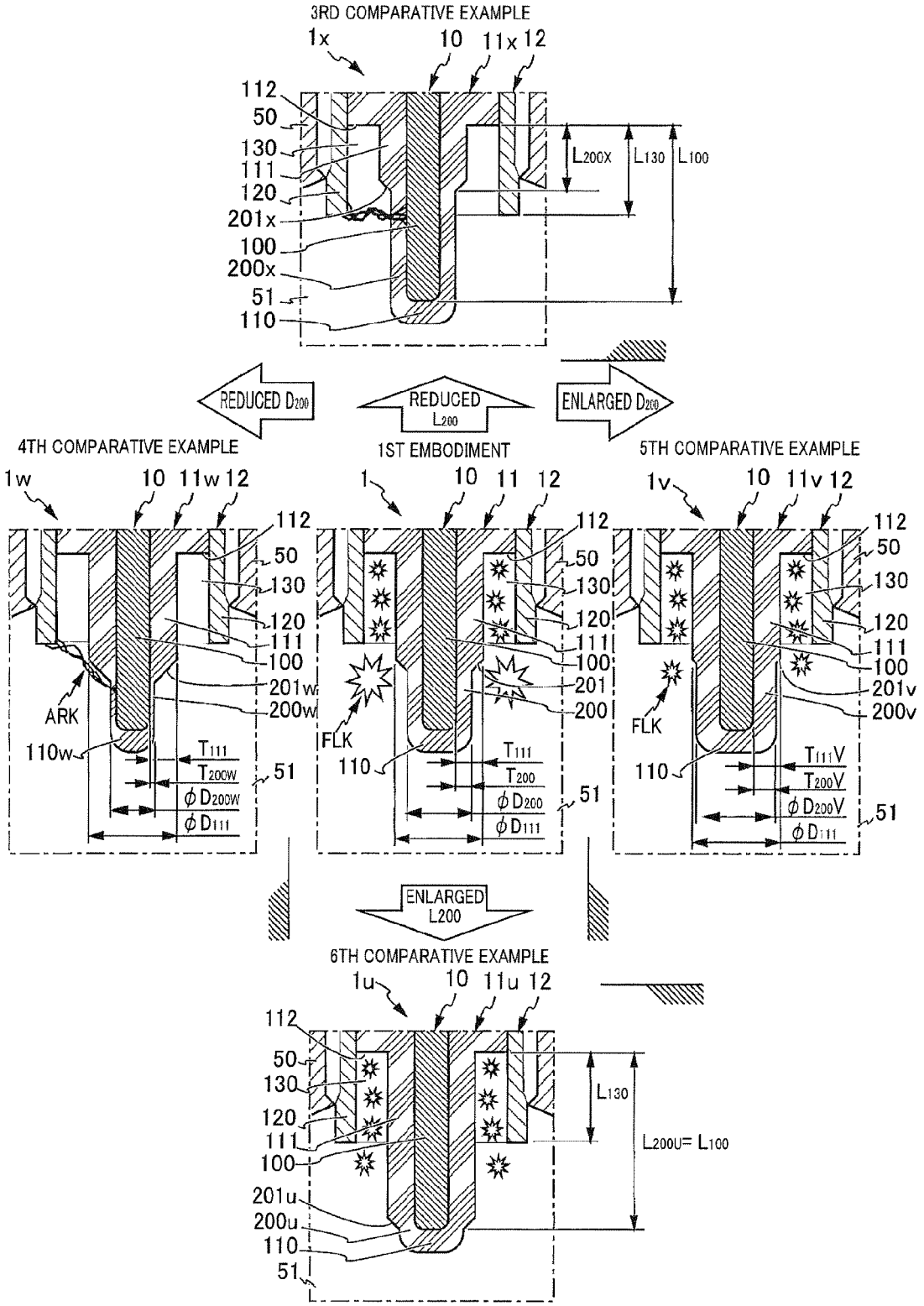
FIG. 6 schematically shows cross-sectional views of principal parts in critical conditions that are not able to exert the effects of the present disclosure when changing the setting condition of the components of the ignition system in the first embodiment of the present disclosure in third to sixth comparative examples.

The critical conditions that are not able to exert the effects of the present disclosure when changing the setting condition of the components of the ignition system 1 in the first embodiment of the present disclosure will be explained with reference to FIG. 6.

In the same configuration as the first embodiment, ignition systems 1*x*, 1*w*, 1*v*, and 1*u*, of which the thin-walled end position length $L_{200}$ and the outer diameter of the thin-walled portion $D_{200}$ are changed to limits that no longer exert the effects of the present disclosure, are prepared as comparative examples 3~6.

In the ignition system 1*x* shown as the third comparative example, the thin-walled end position length $L_{200}x$ is set shorter than the discharge space length $L_{130}$ (specifically, for example, 2.0 mm), the diameter-changing portion 201*x* is positioned to the base end side rather than the tip portion 120, and the thickness $T_{200}$ of the thin-walled portion 200*x* is set to the same as that of the first embodiment (specifically, for example, 1.6 mm).

In the ignition system 1*w* shown as the fourth comparative example, the thin-walled end position length $L_{200}$ is set to the same as that of the first embodiment, and the thickness $T_{200}w$ of the thin-walled portion 200*w* is set to 20% of the thickness $T_{111}$ of the tubular tip portion 111 (specifically, for example, 0.4 mm).

In the ignition system 1*v* shown as the fifth comparative example, the thin-walled end position length $L_{200}$ is set to the same as that of the first embodiment, and the thickness $T_{200}v$ of the thin-walled portion 200*v* is set to 90% of the thickness $T_{111}$ of the tubular tip portion 111 (specifically, for example, 1.8 mm).

In the ignition system 1*u* shown as the sixth comparative example, the thin-walled end position length $L_{200}u$ is set longer than the discharge space length $L_{130}$ but equal to the discharge portion length $L_{100}$ (specifically, for example, 7.0 mm), and the thickness $T_{200}$ of the thin-walled portion 200*u* is set to the same as that of the first embodiment (specifically, for example, 1.6 mm).

Effects of the present disclosure are explained with reference to FIGS. 6, 7, 8 and 9.

The A/F lean limit when using the ignition systems 1, 1*z*, 1*y*, 1*x*, 1*w*, 1*v*, and 1*u* mentioned above is tested by applying the AC voltage for 1 ms with a frequency f set to 300 kHz, and an applied voltage Vpp set to 50 kV as the input energy. Further, the engine speed is set to 2000 rpm, and an indicated mean effective pressure Pmi is set to 300 kPa.

As a result, in the ignition system 1*z* shown as the first comparative example, there is no flame growth under a condition of A/F>19 even if a volume ignition occurs, and thus the internal combustion engine 5 is not ignited.

Figure 7:
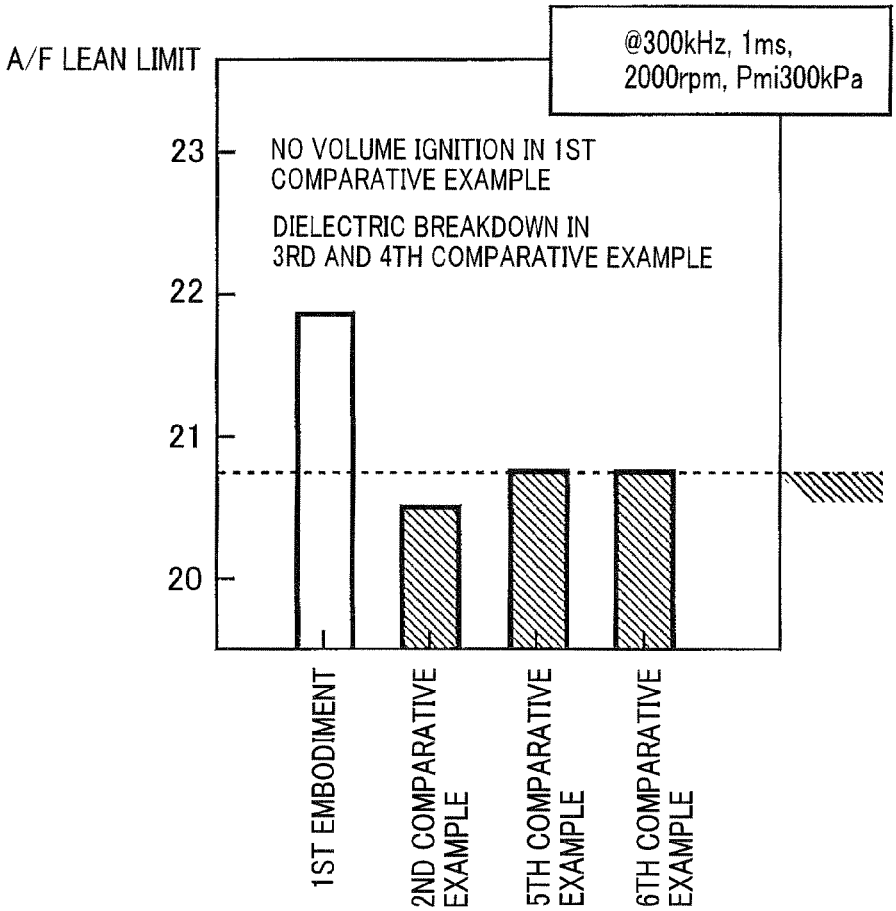
FIG. 7 shows a characteristic diagram showing effects in A/F lean limit improvement in the present disclosure and the comparative examples.
Figure 8:
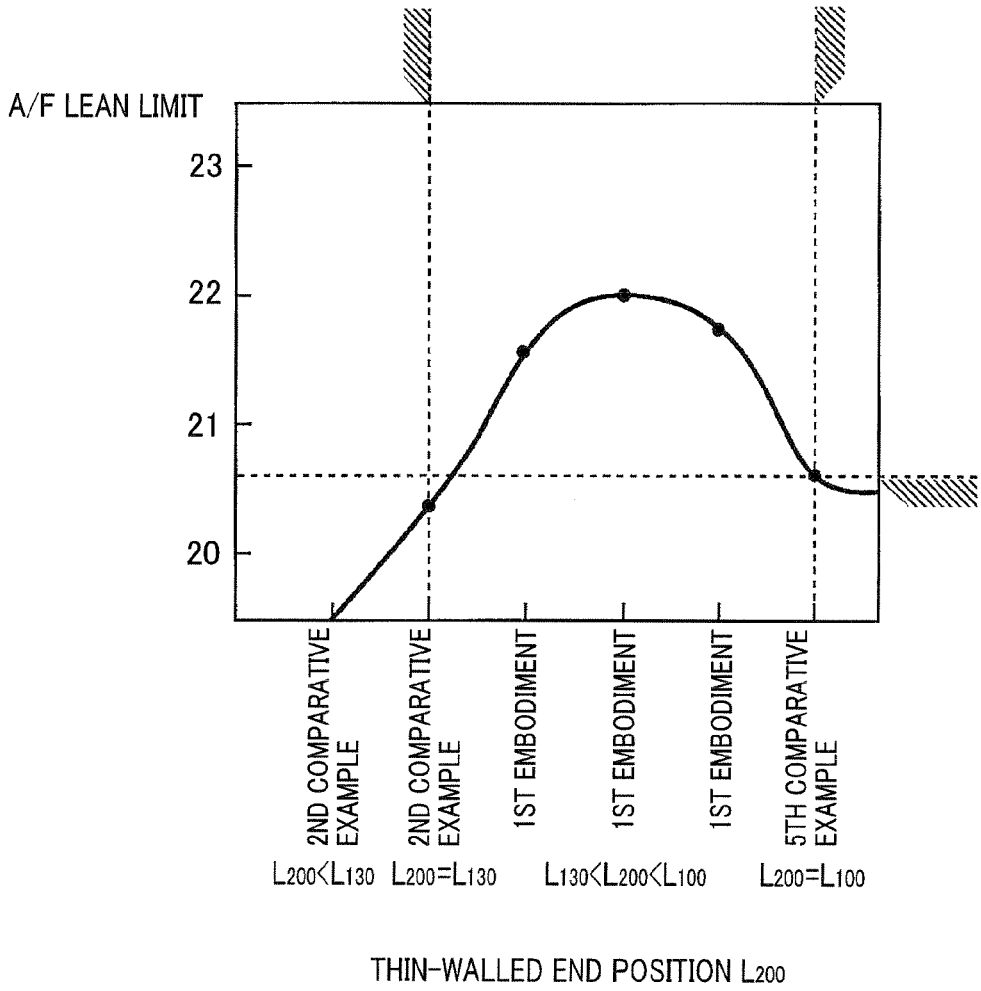
FIG. 8 shows a characteristic diagram showing effects obtained when changing thin-walled end position lengths in the present disclosure and the comparative examples.
Figure 9:
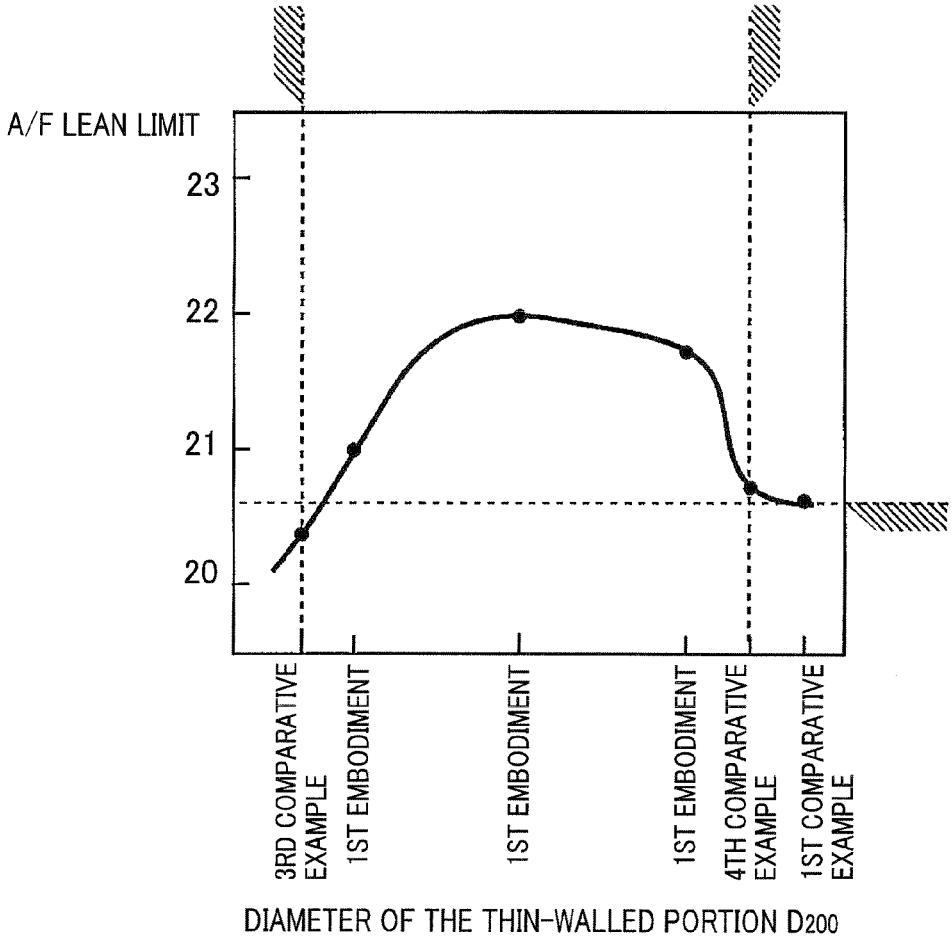
FIG. 9 shows a characteristic diagram showing effects obtained when changing outer diameters of the thin-walled portions in the present disclosure and comparative example.

In the ignition system 1*y* shown as the second comparative example, the ignition of the internal combustion engine 5 has become possible; however, the A/F lean limit is the lowest value, as shown in FIG. 7.

Further, in the ignition system 1*x* shown as the third comparative example, a dielectric breakdown occurs at a position facing the tip portion 120 of the thin-walled portion 200*x*, and arc discharge ARK occurs between the discharge portion 100 and the tip portion 120. When arc discharge occurs, the ground electrode 120 is consumed and a durability of the ignition system 1*x* is significantly reduced.

In the ignition system 1*w* shown as the fourth comparative example, the dielectric breakdown occurs at a position closest to the base end side of the thin-walled portion 200*w*, and the arc discharge ARK occurs between the discharge portion 100 and a distal end position of the tip portion 120.

In the ignition system 1*v* shown as the fifth comparative example, although the A/F lean limit becomes slightly higher as compared with that of the second comparative example, it is found that the effect of the present disclosure cannot be obtained if the thickness $T_{200}$v of the thin-walled portion 200*v* becomes thicker, and the value becomes similar to that of the second comparative example.

In the ignition system 1*u* shown as the sixth comparative example, although the A/F lean limit becomes slightly higher as compared with that of the second comparative example, it is found that the effect of the present disclosure cannot be obtained if the length $L_{200}$ becomes longer, and the value becomes similar to that of the second comparative example.

Thus, in the ignition system 1 in the first embodiment of the present disclosure, it is found that the stable ignition becomes possible with a higher A/F lean limit than that of the conventional system even if a high voltage AC power supply having a relatively low frequency is used by forming the diameter-changing portion 201 that satisfies the relationship of $L_{130}<L_{200}<L_{100}$ when the thin-walled end position length is defined to $L_{200}$.

More desirably, it is found that a high A/F lean limit can be maintained by forming the diameter-changing portion 201 that satisfies the relationship of 3 mm<=$L_{200}$<=10 mm.

Furthermore, it is found that the stable ignition becomes possible with the higher A/F lean limit than that of the conventional system even if the high voltage AC power supply having a relatively low frequency is used by setting the thickness $T_{200}$ of the thin-walled portion 200 that satisfies the relationship of $D_{200}<D_{111}$ and $0.2T_{111}<T_{200}<0.9T_{111}$ when the outer diameter of the tubular tip portion 111 is defined as $\phi D_{111}$, the thickness thereof is defined as $T_{111}$, the outer diameter of the thin-walled portion 200 is defined as $\phi D_{200}$, and the thickness thereof is defined as $T_{200}$.

Further, more preferably, it is found that the high A/F lean limit can be maintained even if the high voltage AC power supply having a relatively low frequency is used by setting the thickness $T_{200}$ of the thin-walled portion 200 that satisfies the relationship of 0.4 mm<=$T_{200}$<=1.8 mm.

Figure 10:
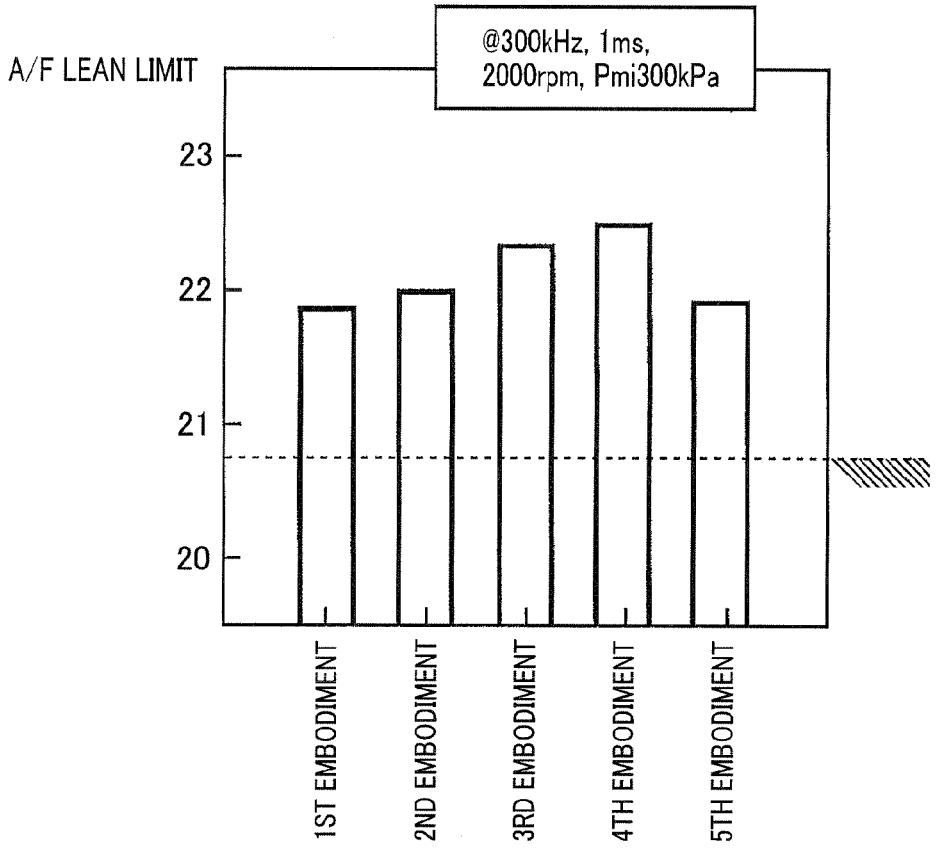
FIG. 10 shows a characteristic diagram showing effects of other embodiments in the present disclosure.

With reference to FIG. 10, effects of the other embodiments of the present disclosure shown in FIG. 11A~FIG. 11D are explained.

As a result of a test performed similar to the above tests, it is found that the stable ignition can be realized in either embodiment at the A/F lean limit higher than that of the comparative examples.

In particular, improvements of the A/F lean limit are found in the third and fourth embodiments.

It is assumed that it becomes possible to improve the energy density near the boundary between the combustion chamber 51 and the tip portion 120 since more electrolysis concentration is caused by projecting a part of the tip portion 120 inwardly.

With reference to FIGS. 11A, 11B, 11C, 11D, and 11E, the other embodiments of the present disclosure are briefly explained. Each of the embodiments has a basic structure of the first embodiment, and has a feature described below.

Figure 11A:
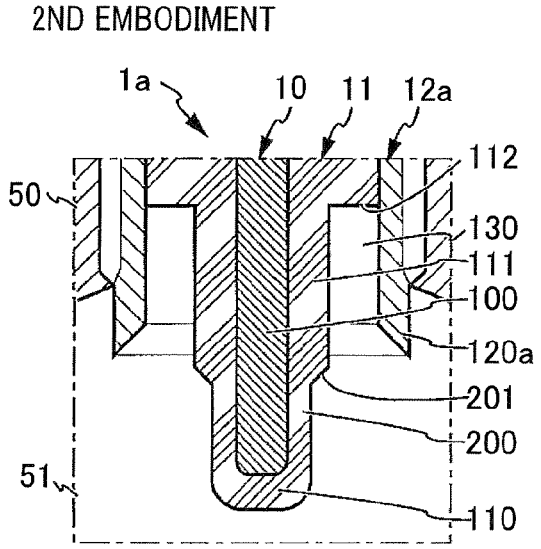
FIG. 11A shows a cross sectional view of an outline of an ignition system in a second embodiment of the present disclosure.

In the ignition system 1*a* of the second embodiment of the present disclosure shown in FIG. 11A, a substantially conical shaped tapered surface is formed. By forming the tapered surface on the tip of the tip portion 120*a*, the energy density near the boundary between the combustion chamber 51 is further improve since an electric field concentration on the tip portion 120*a* is caused, and the flame kernel occurred in the discharge space 130 caused by the tapered surface becomes easy to spread within the combustion chamber 51.

Figure 11B:
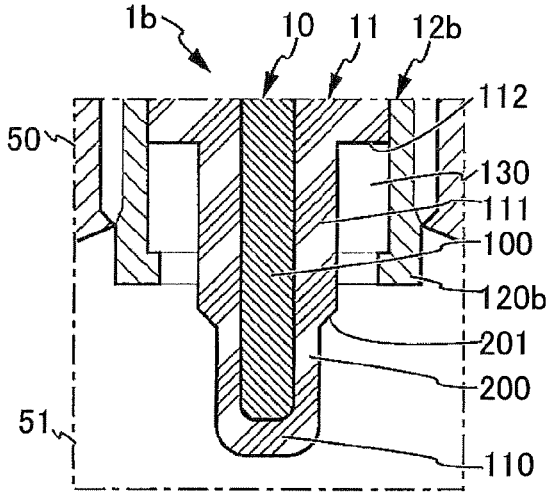
FIG. 11B shows a cross sectional view of an outline of an ignition system in a third embodiment.

In the ignition system 1*b* of the third embodiment of the present disclosure shown in FIG. 11B, a part of the inner circumferential surface of the tip portion 120*a* is projected substantially annularly toward the center dielectric 11. By projecting the part of the inner circumferential surface of the tip portion 120*a*, the energy density near the boundary between the combustion chamber 51 is further improved since the electric field concentration on the tip portion 120*a* is caused.

Figure 11C:
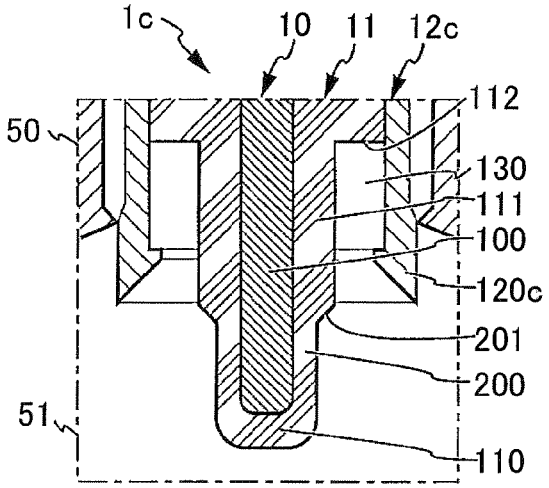
FIG. 11C shows a cross sectional view of an outline of an ignition system in a fourth embodiment.

In the ignition system is of the fourth embodiment of the present disclosure shown in FIG. 11C, the configuration of FIG. 11A and the configuration of FIG. 11B are combined. That is, a part of the inner circumferential surface of the tip portion 120*a* is projected inwardly and a tapered surface is formed thereon so that the energy density is further improved by the electric field concentration.

Figure 11D:
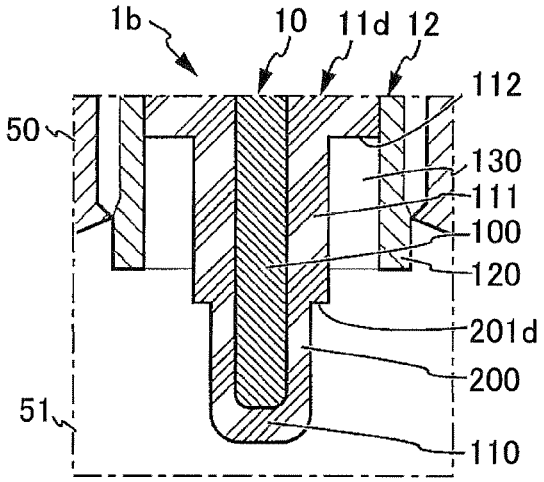
FIG. 11D shows a cross sectional view of an outline of an ignition system in a fifth embodiment.

In the ignition system 1*d* of the fifth embodiment of the present disclosure shown in FIG. 11D, the diameter-changing portion 201*d* is formed in a stepped shape that the diameter thereof is reduced steeply not like that of the ignition system 1 of the first embodiment that has a tapered surface that the diameter thereof is reduced gradually.

With the shape mentioned above, the electric field becomes easier to get concentrated at an outer peripheral edge of a corner-shaped diameter-changing portion 201*d*, and the energy density in surroundings is further improved.

Figure 11E:
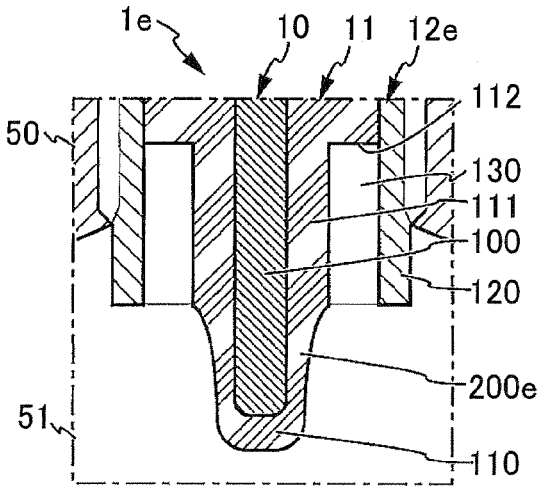
FIG. 11E shows a cross sectional view of an outline of an ignition system in a sixth embodiment.

In the ignition system 1*e* of the sixth embodiment of the present disclosure shown in FIG. 11E, the thin-walled portion 200*e* is formed by a curved surface that is dented inwardly.

With the shape mentioned above, in addition to the effects similar to those of the ignition system 1, durability can be expected to improve by increasing the mechanical strength of the central dielectric 11*e*.

Incidentally, the present disclosure is not limited to the above embodiment, but may be appropriately modified to the extent that is not inconsistent with the purpose of the present disclosure, that is, to expose a part of the central dielectric and form a thin-walled portion therein by reducing a wall thickness thereof so that the surface potential becomes high and the energy density on the surroundings also becomes high.

As a result, the volume ignition is caused effectively by causing the streamer discharge with relatively low energy using the AC voltage having a frequency lower than the conventional system.

For example, by making an inner diameter of the annular tip portion of the ground electrode widening stepwise toward the axial direction, it is possible to provide a plurality of electric field concentration portions in the ground electrode side.

As a result, occurrence range of the streamer discharge in the ground electrode side can be extended radially, and further improvement in ignitability can be expected.

What is claimed is:

1. An ignition system for an internal combustion engine comprising:

a substantially shaft-like center electrode that has a length with a base end and a tip end in both ends thereof;

a substantially bottomed cylindrical center dielectric disposed coaxially with the center electrode;

a substantially cylindrical ground electrode disposed coaxially with the center dielectric with a discharge gap having a predetermined distance therebetween;

a power source that applies a high voltage between the center electrode and the ground electrode;

a discharge portion of the center electrode in which a part thereof is surrounded by a bottom portion of the center dielectric;

a tubular tip portion of the center dielectric;

the part of the discharge portion and the tubular tip portion are projected into a combustion chamber of the internal combustion engine from a substantially annular tip portion of the ground electrode that opens to the combustion chamber at a distal end of the ground electrode;

a diameter-changing portion formed by reducing a diameter of a part of the tubular tip portion in a radial direction gradually as approaching toward a tip thereof; and a thin-walled portion formed by reducing a thickness of the tip of the tubular tip portion.

2. The ignition system for the internal combustion engine according to claim 1, wherein, a substantially cylindrical discharge space is formed by a part of an outer peripheral surface of the tubular tip portion, a bottom end formed by enlarging a base end side of the tubular tip portion in a radial direction, and an inner circumferential surface of a tubular portion of the ground electrode; and when measured from an inner bottom surface of the bottom end, a length to a distal end of the discharge portion is defined as a discharge portion length $L_{100}$, a length to a distal end of the discharge space is defined as a discharge space length $L_{130}$, and a length to the diameter-changing portion is defined as a thin-walled end position length $L_{200}$, a relationship of $L_{130}<L_{200}<L_{100}$ is satisfied.

3. The ignition system for the internal combustion engine according to claim 1, wherein, a substantially cylindrical discharge space is formed by a part of an outer peripheral surface of the tubular tip portion, a bottom end formed by enlarging a base end side of the tubular tip portion in a radial direction, and an inner circumferential surface of a tubular portion of the ground electrode; and when measured from an inner bottom surface of the bottom end, a length to a distal end of the discharge portion is defined as a discharge portion length $L_{100}$, a length to a distal end of the discharge space is defined as a discharge space length $L_{130}$, and a length to the diameter-changing portion is defined as a thin-walled end position length $L_{200}$, a relationship of 3 mm$<=L_{200}<=$10 mm is satisfied.

4. The ignition system for the internal combustion engine according to claim 1, wherein, when an outer diameter of the tubular tip portion is defined as $\phi D_{111}$, a thickness thereof is defined as $T_{111}$, an outer diameter of the thin-walled portion is defined as $\phi D_{200}$, and a thickness thereof is defined as $T_{200}$, relationships of $D_{200}<D_{111}$ and $0.2T_{111}<T_{200}<0.9T_{111}$ are satisfied.

5. The ignition system for the internal combustion engine according to claim 1, wherein, when an outer diameter of the tubular tip portion is defined as $\phi D_{111}$, a thickness thereof is defined as $T_{111}$, an outer diameter of the thin-walled portion is defined as $\phi D_{200}$, and a thickness thereof is defined as $T_{200}$, a relationship of 0.4 mm$<=T_{200}<=$1.8 mm is satisfied.

6. The ignition system for the internal combustion engine according to claim 1, wherein, a frequency of the voltage supplied from the power supply is more than 80 kHz, and less than 850 kHz.

7. The ignition system for the internal combustion engine according to claim 2, wherein, a volume of the discharge space is 300 $mm^3$ or less.

8. The ignition system for the internal combustion engine according to claim 3, wherein, a volume of the discharge space is 300 $mm^3$ or less.

* * * * *